United States Patent [19]

Kovacs et al.

[11] 3,943,683

[45] Mar. 16, 1976

[54] PACKAGING APPARATUS

[75] Inventors: Lloyd Kovacs, Sheboygan; Dale Mark Cherney, Howards Grove, both of Wis.

[73] Assignee: Hayssen Manufacturing Company, Sheboygan, Wis.

[22] Filed: Mar. 19, 1975

[21] Appl. No.: 559,733

[52] U.S. Cl. ..... 53/51; 53/75; 53/180 R

[51] Int. Cl.[2] ..... B65B 57/00; B65B 51/30

[58] Field of Search ..... 53/51, 75, 180

[56] References Cited

UNITED STATES PATENTS

| | | | |
|---|---|---|---|
| 2,976,657 | 3/1961 | Cloud | 53/75 |
| 3,320,718 | 5/1967 | Thesing | 53/180 |

*Primary Examiner*—Travis S. McGehee

*Attorney, Agent, or Firm*—Koenig, Senniger, Powers and Leavitt

[57] ABSTRACT

Packaging apparatus for packaging units in flexible sheet material with the units spaced longitudinally in a tube formed of a web of the material and with the tube sealed together between successive units. The apparatus includes a rotary sealing wheel carrying a series of sealing assemblies for sealing the tube, the sealing assemblies being uncoupled from the wheel and held at a hold position for again being released in timed relation to movement of the tube for sealing the tube between successive units. The apparatus also includes an electronic pulse counter or encoder driven at a speed proportional to the speed of the wheel to effect the release of a sealing unit in the event the passage of a unit to be packaged is not sensed by a photoelectric sensor when packaging the units in unprinted sheet material, or to control the placement of units to be packaged on a web of the material having registration marks preprinted thereon.

7 Claims, 10 Drawing Figures

PACKAGING APPARATUS

BACKGROUND OF THE INVENTION

This invention relates to packaging apparatus, and more particularly to apparatus for packaging a product in a tubular bag having its ends sealed closed.

Specifically, this invention relates to an improvement on packaging apparatus as disclosed in U.S. Pat. No. 2,976,657 to Cloud in which a product to be packaged is placed on a web, and the web is formed into a tube around the product and sealed and severed in front of and behind the product to form a bag. In the above-mentioned Cloud patent, the entubed products pass around a so-called rotary turret or wheel. A plurality of clamping assemblies or die sealing units are held stationary in a rest or hold position at one location on the wheel with the wheel rotating relative to the sealing units when the latter are in their hold position. In timed relation to movement of the portions of the tube between successive products therein, the sealing units are released one at a time from the hold position and are coupled to the wheel for being driven by the wheel. Each sealing unit has a fixed lower jaw and a hinged upper jaw swingable from an open to a closed position as the sealing unit moves from the hold position so as to clamp the tube between the jaws intermediate successive products in the tube. The jaws may be heated so as to heat-seal the tube, or may include other means to otherwise seal the tube transversely across the tube. Also, the jaws may carry a severing blade (or a heated wire) for severing the tube within the seal formed by the jaws thereby to form the trailing end seal of a leading bag and the leading end seal of a trailing bag. The jaws securely grip the web as the die moves with the wheel and thus pull the tube and products therein through the apparatus at the speed of the wheel.

As shown in the above-mentioned Cloud patent, the sealing units are released by an electric eye control system which senses the passage of registration marks preprinted at intervals on the web. This electric eye control system also actuates a so-called stop gate for controlling placement of the units to be packaged in spaced relation to the registration marks. Thus, the electric eye control system places the units to be packaged on the web in proper relation to the registration marks thereon and releases the sealing units in timed relation to movement of the registration marks so as to properly seal and sever the tube between successive units therein.

In other packaging apparatus generally similar to that shown in the above-mentioned U.S. Pat. No. 2,976,657, other means, such as another photoelectric control system, was provided for sensing the position of units to be packaged on the web and to effect coupling of a sealing unit to the wheel in timed releation to the movement of the units with the web. Thus, unprinted or clear web as well as printed web could be utilized to package units. However, if one or more of the units to be packaged was not placed on the web, this other photoelectric control system would not sense the presence of the units in the tube and thus would not release the sealing units. Hence, if several units in a row were not placed on the web and if sealing units were not released from the hold position, after a partial revolution of the wheel the sealing units would no longer be in gripping engagement with the web so as to pull it along its path through the apparatus. Furthermore, an excessive number of sealing units may accumulate at the hold position with possible damage to some of the sealing units. Thus, a limit switch actuable by the movement of the sealing units with the wheel was provided for releasing a sealing unit at some time after the next sealing unit should have been released by the above-mentioned other photoelectric control system. If, however, this other photoelectric control system functioned properly and released a sealing unit at the desired time, another limit switch actuable by the just-released sealing unit reset the first-mentioned limit switch and thus prevented it from releasing another die. In packaging units within a preprinted web, this first-mentioned limit switch was used to generate a signal to automatically position the units to be packaged on the web relative to registration marks preprinted on the web.

However, the above-mentioned limit switches, when adjusted for various package lengths, were found to interfere with the release of the sealing units and prevented access to certain parts of the apparatus. Also, adjustment of the position of the limit switches within the apparatus for accommodating various package lengths could not readily be accomplished by an operator from an operator's station.

SUMMARY OF THE INVENTION

Among the several objects of this invention may be noted the provision of packaging apparatus, such as above described, which is operable with both printed and unprinted webs; the provision of such apparatus which, when operating in an unprinted or plain web mode, will continue to grip the web and to pull it through the apparatus in the event one or a series of units to be packaged are not placed on the web; the provision of such apparatus which may be remotely adjusted from an operator's position to accommodate various package lengths when operated in either the plain or printed web mode; the provision of such apparatus which prevents damage to the sealing units; and the provision of such apparatus which is of rugged construction and which is reliable in operation at high production speeds. Other objects and features of this invention will be in part apparent and in part pointed out hereinafter.

Briefly, apparatus of this invention for packaging units in flexible sheet material with the units spaced longitudinally in a tube of this material has means for sealing the tube between the units. This sealing means comprises a wheel rotatable on an axis and a series of sealing units carried by the wheel. Each sealing unit has means for coupling it to the wheel for travel therewith and for uncoupling the sealing unit from the wheel to allow the wheel to rotate while the sealing unit remains stationary. Means is provided for arresting a first sealing unit at a hold position and for actuating its coupling means to uncouple it from the wheel, this arresting means being movable between an operative position in which it is engageable by the coupling means of the above-stated first sealing unit to arrest this first sealing unit and to uncouple it from the wheel and a retracted position for release of the sealing unit to travel with the wheel. The arresting means is movable from its operative to its retracted position in response to a signal for coupling the first sealing unit to the wheel in timed relation to movement of the units with the tube for sealing the latter between successive units. Means is provided for generating the above-stated signal in response to passage of a unit by a reference point, and backup means is provided for generating this signal in response to movement of the wheel through a distance greater than a predetermined distance for the units being packaged in the event the above-stated generating means fails to sense the passage of a unit by its reference point. The backup means is reset prior to generating its signal by the release of a sealing unit in response to generation of the signal by the above-mentioned generating means. The backup means comprises means for generating a number of pulses corresponding to the wheel moving through a unit length and means for counting these pulses and for generating a signal upon counting a specified number of pulses corresponding to the above-stated distance greater than the predetermined distance for the units.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
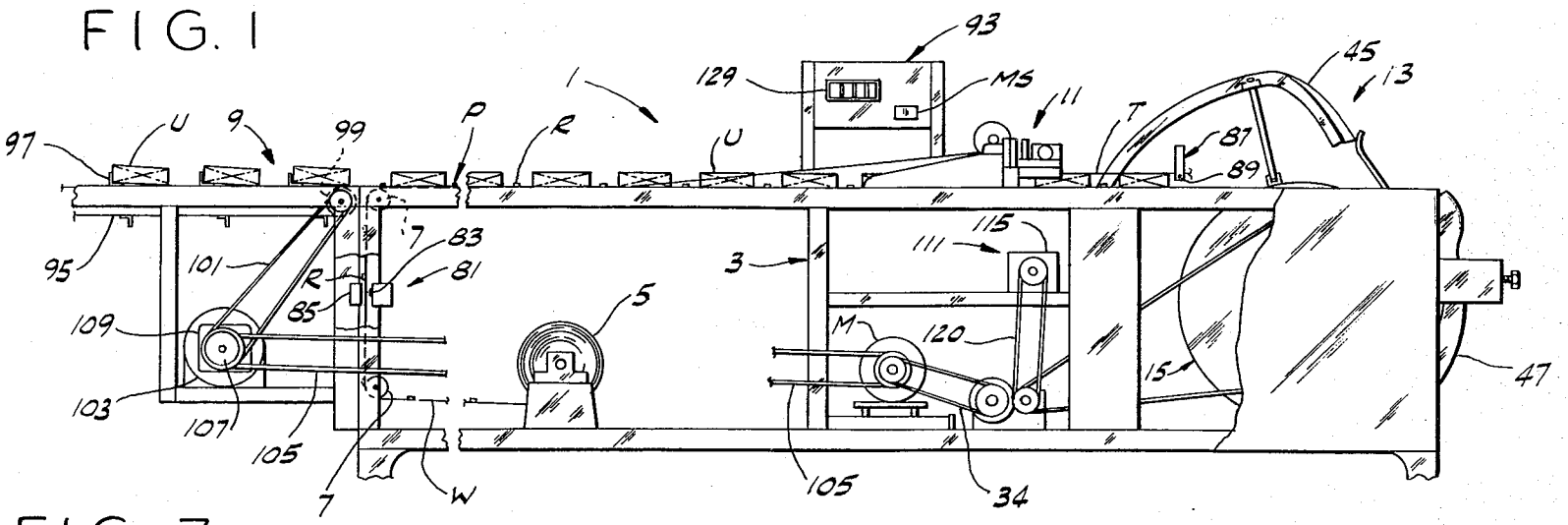
FIG. 1 is a simplified side elevational view of apparatus of this invention with parts broken away and with other parts omitted to illustrate key components of the apparatus.

Referring now to the drawings, packaging apparatus 1 of this invention is shown to comprise a frame 3 for supporting a roll 5 of flexible web material W, such as heat-sealable plastic film, heat-sealable laminate sheet material, or the like, The web travels over rollers 7 along a path P through the apparatus. More particularly, web W moves past an infeed conveyor 9 at which point units U are fed onto the upper face of the web at substantially equal longitudinal intervals along the web. As indicated at 11, means is provided along the path P forming the web into a tube T surrounding the units. This tube forming means folds up the side margins of the web on the units and forms a continuous longitudinal back seal joining the side margins of the web. The tube with the units U therein is moved along its path P toward means generally indicated at 13 for sealing and severing the tube between successive units U at package length intervals thereby to form a sealed bag around each unit.

Figure 2:
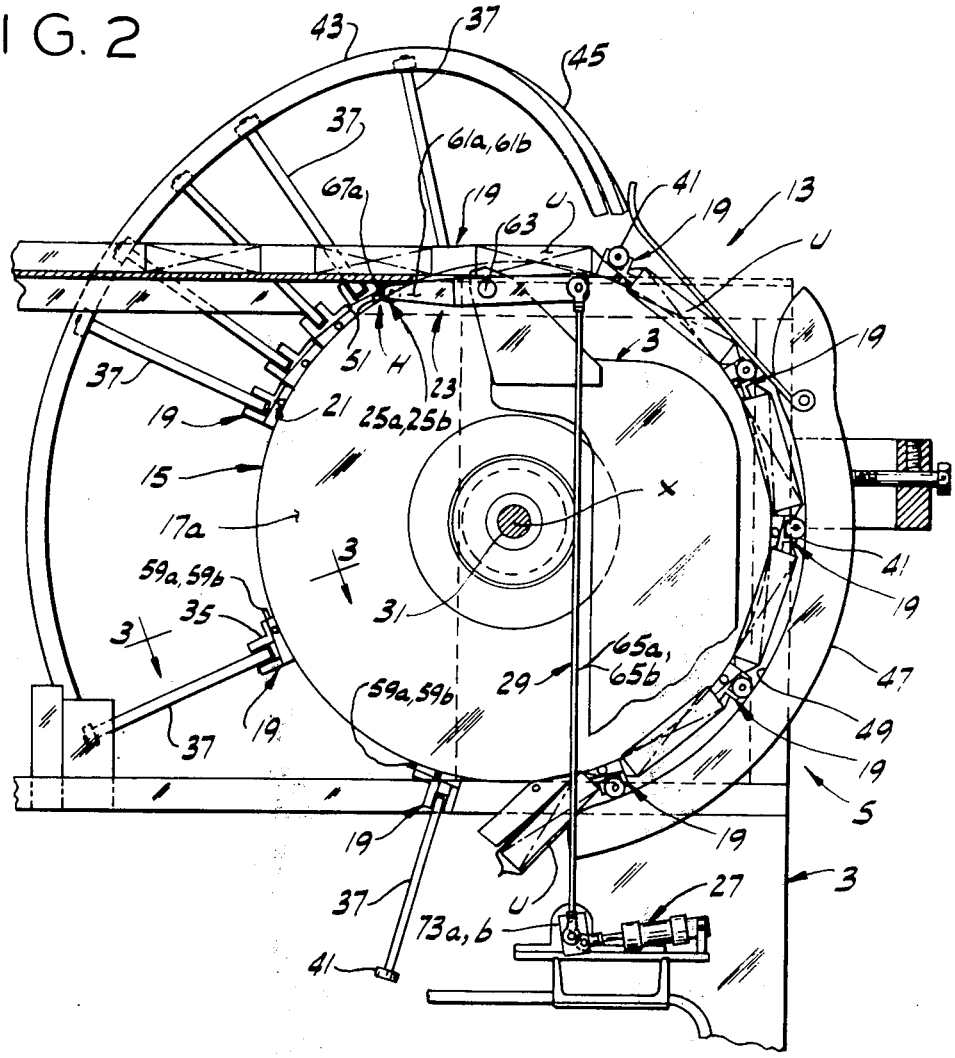
FIG. 2 is an enlarged view of a portion of the apparatus shown in FIG. 1 with some parts broken away illustrating a wheel, a series of sealing unit carried by the wheel, and means for arresting a plurality of the sealing units at a hold position and for releasing the first sealing unit at the hold position to travel with the wheel.

More particularly, sealing means 13 comprises a wheel 15 rotatable on a horizontal axis X and having two spaced, circular side plates **17*a*,17*b*. The sealing means further comprises a series of sealing assemblies or units, each sealing unit being indicated at 19, carried by the wheel. Each sealing unit 19 has means 21 (see FIGS. 2–5) for coupling it to both side plates 17*a*,17*b* of wheel 15 for travel with the wheel and for uncoupling it from the wheel to allow the wheel to rotate relative to the sealing unit while the sealing unit remains stationary. At 23 is indicated means for arresting a first sealing unit 19 at a hold position H and actuating its coupling means 21 to uncouple it from the wheel. Successive sealing units 19 trailing the first unit are arrested by interengagement behind the arrested unit, and the coupling means thereof are actuated to uncouple the successive sealing units from wheel 15. As shown in FIG. 2, arresting means 23 comprises a pair of stops 25*a*,25*b*, one at each side of the wheel, movable between an operative position (as shown in FIG. 4) wherein the stops are engageable by coupling means 21 of the first sealing unit at hold position H to simultaneously uncouple this first sealing unit from both side plates 17*a*,17*b* of wheel 15 and a retracted position (see FIG. 5) for release of the sealing unit to travel with the wheel and for simultaneously coupling it to both sides of the wheel. A single cylinder actuator unit 27 is provided for stops 25*a*,25*b*, and a linkage arrangement, generally indicated at 29, interconnects actuator cylinder unit 27 and stops 25*a*,25*b*** for simultaneous movement of the stops between their operative and retracted positions.

More particularly, wheel plates **17*a*,17*b* are spaced apart a distance somewhat greater than the maximum width of units U which can be packaged by apparatus 1. The plates are secured to a shaft 31 which is journalled by frame 3. Each side plate has a respective groove 33*a*,33*b* in its inner face adjacent its periphery (see FIG. 3). Wheel 15 is rotatably driven by a motor M via a chain and sprocket drive assembly 34**.

Figure 3:
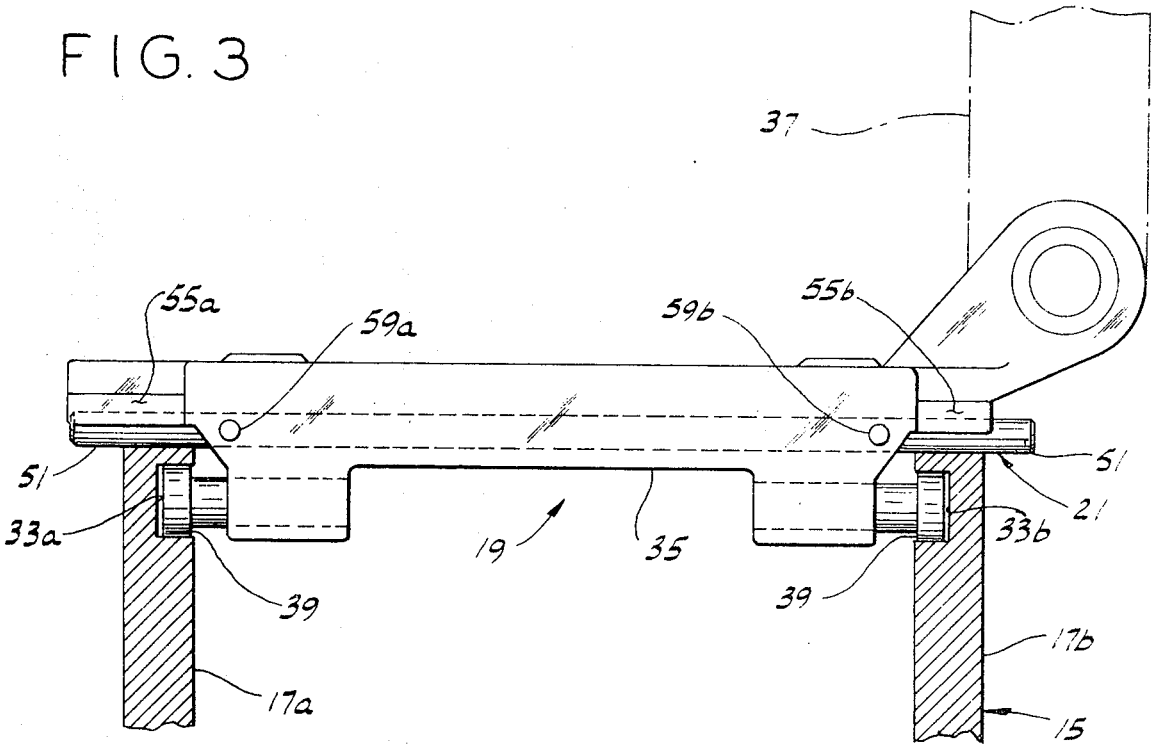
FIG. 3 is an enlarged vertical cross section taken on line 3—3 of FIG. 2 illustrating a sealing unit with its upper jaw (shown in phantom) in a raised or open position.
Figure 4:
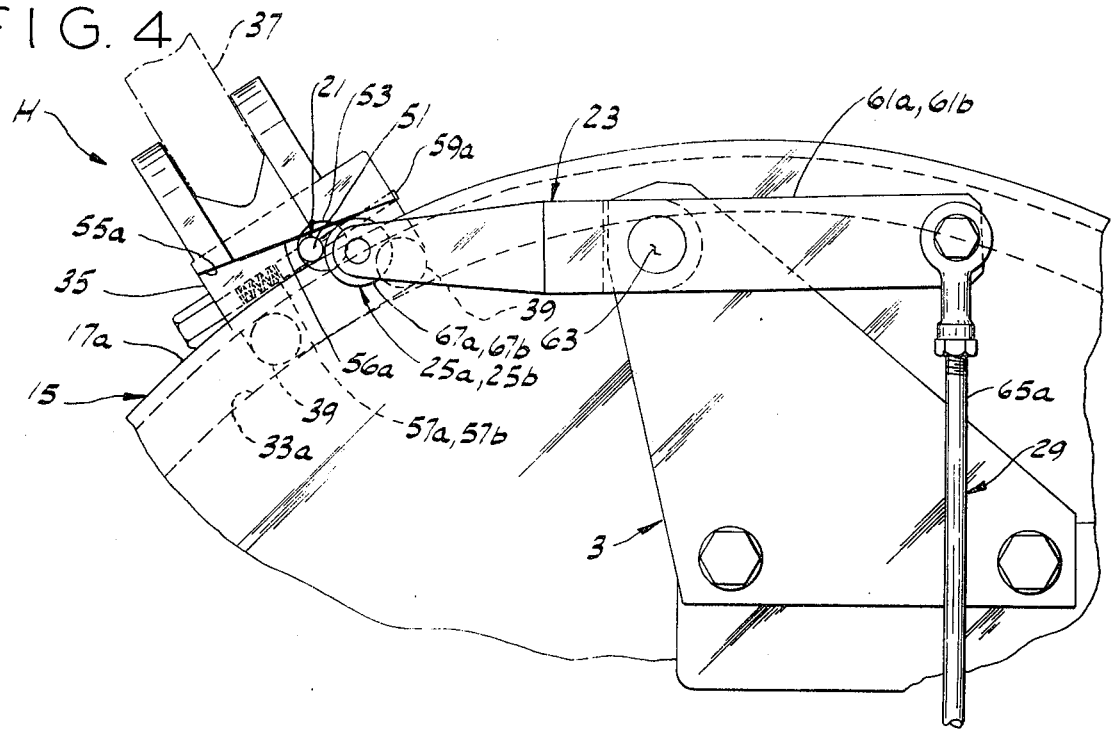
FIG. 4 is an enlarged view of a portion of the apparatus shown in FIG. 2 illustrating the arresting means in its operative position.
Figure 5:
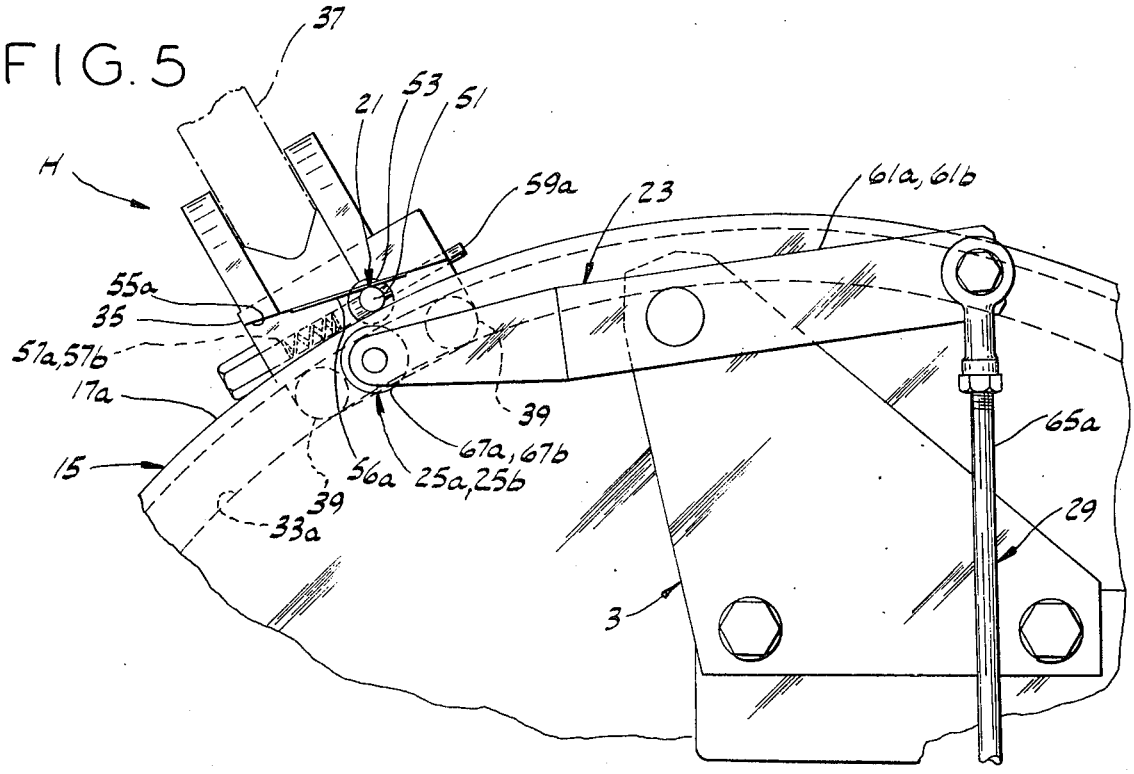
FIG. 5 is a view similar to FIG. 4 illustrating the arresting means in its retracted position.

As shown in FIGS. 3–5, each sealing unit 19 includes a base 35 extending laterally between and beyond wheel plates **17*a*,17*b*, this base constituting a fixed or lower sealing jaw and hingedly carrying an upper sealing jaw 37 swingable between an open position (e.g., the position of the upper jaws of sealing units 19 in hold position H) and a closed position (e.g., the position of the upper jaws of sealing units at the right side of wheel 15 in FIG. 2) in which the jaws clamp tube T therebetween. As disclosed in the heretofore-mentioned U.S. Pat. No. 2,976,657, the jaws may be heated for heat-sealing the tube and may carry blades (not shown) for severing the tube between successive units U. With the jaws closed and clamped to the tube and with the sealing units positively coupled to the wheel 15, the sealing units pull web W and tube T along path P through the apparatus as the sealing units rotate with the wheel through a sealing zone S. As shown in FIG. 2, more than one sealing unit grips the tube at any one time and thus the tube is continuously conveyed along its path P at substantially the surface speed of the sealing units carried by wheel 15**.

More particularly, base 35 of each sealing unit 15 has a pair of rollers at each side thereof, each of these rollers being indicated at 39, received in grooves 33*a*,33*b* in wheel plates 17*a*,17*b*. These rollers transmit substantial clamping forces from the base to wheel 15 as sealing units 19 pass through sealing zone S and also permit movement of wheel 15 relative to the sealing units when the latter are arrested at hold position H. A cam roller 41 (see FIG. 2) is carried by the outer end of movable jaw 37. These rollers are received in a guide track 43 when sealing units 19 are in their hold position to hold the jaws open. The guide track has a cam closing portion 45 which closes the jaws of each sealing unit as the latter is released from hold position H and as it travels with the wheel toward sealing zone S. An arc-shaped pressure cam 47 is spaced from the outer periphery of wheel 15 and extends around a portion of the wheel. The length of pressure cam 47 generally defines sealing zone S. The pressure cam has a cam surface 49 engageable with cam rollers 41 to firmly hold jaw 37 closed on its fixed jaw 35 thereby to positively grip tube T and to seal the tube as heretofore described. Upon exiting the pressure cam, the upper jaw is swung open by gravity (see FIG. 2) and the packaged unit U drops free of wheel 15 onto an outfeed conveyor (not shown).

As shown in FIGS. 3–5, each sealing unit base 35 has a coupling bar 51 extending laterally of the sealing unit out beyond the lateral ends of the sealing unit and beyond side plates 17*a*,17*b* of wheel 15. This coupling bar is received within an enlarged bore 53 in base 35. At each side of base 35 an inclined ramp 55*a*,55*b* is spaced radially outwardly of the outer peripheral surface of wheel plates 17*a*,17*b* with the end of this inclined ramp surface toward the direction of movement of wheel 15 being spaced from the outer periphery of the wheel a distance somewhat less than the thickness of coupling bar 51. A resilient flat spring 56*a* or 56*b* is provided on the downwardly facing surface of respective rams 55*a* and 55*b* for resiliently biasing the coupling bar into engagement with the outer peripheral surfaces of wheel side plates 17*a*,17*b*. Compression coil springs 57*a*,57*b* at opposite lateral ends of base 35 bias coupling bar 51 in the direction of rotation of the wheel toward a coupled position (see FIG. 5) in which the coupling bar is wedged between the outer peripheral surfaces of wheel plates 17*a*,17*b* and springs 56*a*,56*b* thereby to lock the sealing unit to the wheel. The coupling bar is movable against the bias of springs 57*a*,57*b* to an uncoupled position in which the coupling bar is clear of the peripheral surfaces of wheel plates 17*a*,17*b* thereby to uncouple the sealing unit from the wheel. Coupling bar 51 carries a pair of interengagement pins 59*a*,59*b* which are received in apertures in base 35 and which project out beyond the forward end of the base for interengagement with a previously arrested sealing unit 19 at hold position H as the sealing unit enters the hold station. Upon interengagement, pins 59*a*,59*b* move coupling bar 51 from its coupled to its uncoupled position thereby to effect uncoupling of the sealing unit upon interengagement with the next successive unit in the hold position.

More particularly, arresting means 23 comprises a rocker arm 61*a* or 61*b* on each side of wheel 15 pivoted intermediate its ends to frame 3 by a pivot pin 63 carried by the frame. Each rocker arm 61*a*,61*b* has a respective elongate link or rod 65*a*,65*b* pivotally connected to one of its ends and it carries a cam roller 67*a* or 67*b* on its other end. These cam rollers constitute stops 25*a*,25*b*. When rocker arms 61*a*,61*b* are in a raised position (as shown in FIGS. 2 and 4) the stops (i.e., cam rollers 67*a*,67*b*) are in their above-stated operative positions and are engageable by the outer ends of coupling bar 51 of the first sealing unit 19 at hold position H. As best shown in FIG. 4, cam rollers 67*a*,67*b* are adapted to be engaged by the coupling bar above the rotary axis of the cam rollers when the rocker arms are in their operative position (as shown in FIGS. 2 and 4). This insures that the cam rollers may readily be moved downardly to their retracted position. Each sealing unit 19 includes brake means (not shown) frictionally engageable with wheel 15 for preventing the sealing unit from moving from the top of the wheel toward sealing zone S at a speed greater than the rotational speed of the wheel. Thus, wheel 15 applies a force to the sealing units via the above-mentioned brake means and via rollers 39 idling in grooves 33*a*,33*b* to urge sealing units 19 at hold position H in the direction of rotation of the wheel. With coupling rod 51 of the first sealing unit in the series of sealing units at hold station H in engagement with cam rollers 67*a* and 67*b* above the center thereof, the force transmitted to rocker arms 61*a*,61*b* by the sealing units in the hold position causes cam rollers 67*a*,67*b* to move downwardly and thus causes the rocker arms to place their respective rods 65*a*,65*b* under tension loading.

Figure 6:
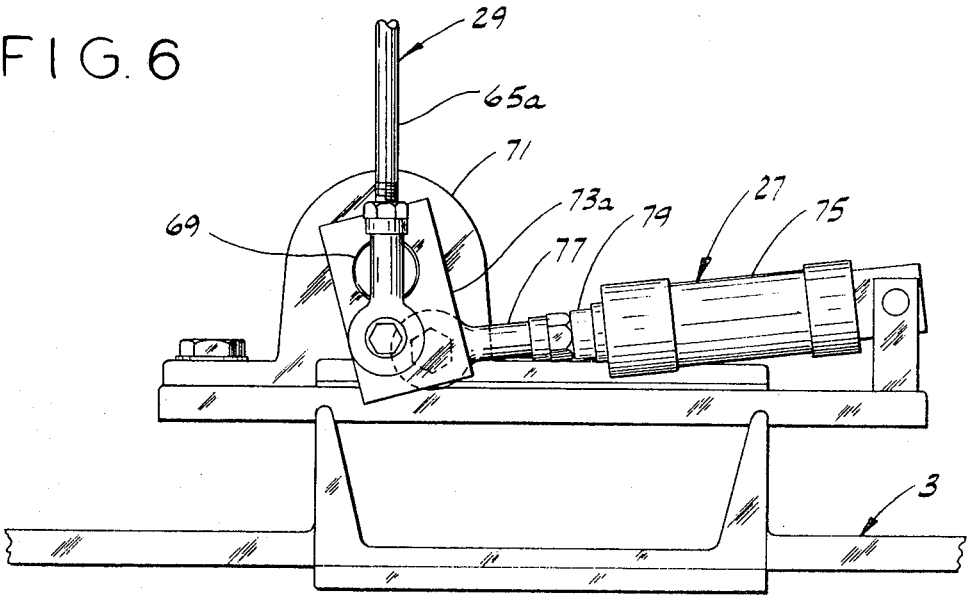
FIG. 6 is an enlarged side elevational view of an actuator for the arresting means.

Linkage 29 further comprises a horizontal crankshaft 69 (see FIG. 6) journalled in bearings 71 secured to frame 3. This crankshaft extends beyond the sides of wheel 15 and has crank arms 73*a*,73*b* fixedly secured to its outer ends. The lower ends of rods 65*a*,65*b* are pivotally secured to the outer face of a respective crank arm 73*a*,73*b* offset from the center of crankshaft 69. Actuator cylinder 27 is shown to be an air cylinder having a cylinder body 75 which is pivotally secured to frame 3 and a piston and piston rod assembly 77 axially movable within the cylinder between an actuated position (not shown) in which the piston and piston rod assembly is moved outwardly relative to the cylinder body and an unactuated or retracted position (see FIG. 6) in which the piston and piston rod assembly is retracted into the cylinder body. The free end of the piston rod is pivotally connected to the inside face of crank arm 73*a* and is spaced laterally from the connection of the lower end of rod 65*a* to the crank arm. Cylinder body 75 has a stop 79 engageable by piston and piston rod assembly 77 to prevent inward movement of the latter into the cylinder beyond a predetermined location. With rocker arms 61*a*,61*b* in their operative positions, it will be noted that the lower ends of rods 65*a*,65*b* are below the axis of crankshaft 69 and preferably on the side of the crankshaft toward actuator cylinder unit 27 so that the tension loading of rods 61*a*,61*b* (as heretofore described) biases the piston and piston rod assembly 77 into body 75. Thus, the arrangement of rods 65*a*,65*b*, piston and piston rod assembly 77 on crank arms 73*a*,73*b*, and stop 79 constitutes overcenter locking means for preventing movement of stops 25*a* and 25*b* from their operative position. Upon pressurization or energization of actuator cylinder 27, crankshaft 69 rotates in clockwise direction (as viewed in FIG. 6) and thus causes rocker arms 61*a*,61*b* to simultaneously rotate in counterclockwise direction to effect movement of stops 25*a* ,25*b* (i.e., cam rollers 67*a*,67*b*) from their operative to their retracted position thereby to release coupling rod 51 of the first sealing unit 19 to hold station H and thus to permit the coupling bar to move from its uncoupled to its coupled position for coupling the sealing unit to wheel 15 for effecting travel of the sealing unit with the wheel. Shortly after coupling rod 51 moves past cam rollers 67*a*,67*b*, actuator cylinder 27 is actuated in reverse direction to return rocker arms 61*a*,61*b* and their cam rollers 67*a*,67*b* to their respective operative positions in which they are in position for engagement by the coupling bar 51 of the next successive sealing units 19 in the series of sealing units at hold position H. It will be noted that with a single actuator cylinder 27 and with linkage 29, stops 25*a*,25*b* are simultaneously retracted from the coupling rod 51 of the first sealing unit at both sides of wheel 15 thereby to insure that both sides of the sealing unit are simultaneously coupled to the wheel. This prevents one side of the sealing unit from being coupled to the wheel before its other side and thus eliminates canting or cocking of the sealing units relative to the wheel.

Actuator cylinder 27 is actuated by a solenoid valve SV which normally pressurizes the cylinder to maintain the rocker arms 61*a*,61*b* in their operative position. Upon receiving an electrical signal, solenoid valve SV vents the normally pressurized end of the cylinder and pressurizes the other end of the cylinder to effect movement of the rocker arms from their operative to their retracted position. Upon deenergization of the solenoid valve, the cylinder is vented and repressurized to return the rocker arms to their operative positions.

Figure 8:
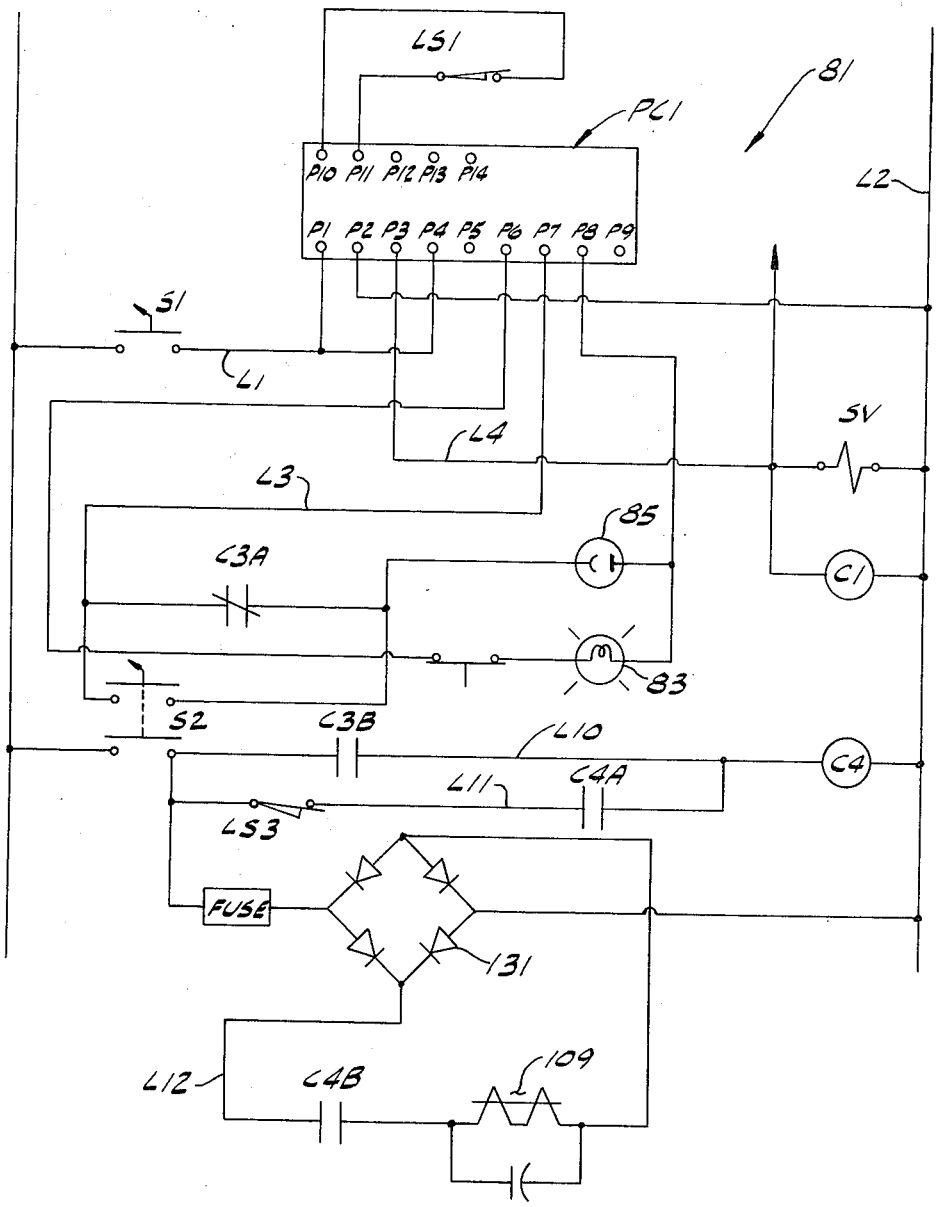
FIG. 8 is an electrical schematic of a photoelectric control system for the apparatus when packaging units in preprinted web.

Apparatus 1 may utilize a web W having either preprinted opaque registration marks R thereon at spaced intervals for the units U being packaged, or it may use unprinted or plain web. A first photoelectric control system 81 as shown in FIG. 8, is provided having a light source or lamp 83 and a photocell 85 on opposite sides of the web for sensing the passage of registration marks R therebetween and for generating a signal which energizes solenoid valve SV so as to effect the release and coupling of sealing units 19 to wheel 15 in timed relation to movement of the registration marks with the printed web. A second photoelectric control system 87 (FIG. 9) is provided adjacent the top of wheel 15 having a light source or lamp 89 and a photocell 91 on opposite sides of tube T. The light beam (constituting a reference point) emitted from light source 89 is broken by units U moving with the tube toward wheel 15 and this in turn causes the output of the photocell 91 to vary and to generate another signal for energization of solenoid valve SV. A control panel 93 is provided at an operator's station and this control panel has a mode selection switch MS for controlling operation of the apparatus for either preprinted or plain web (i.e., the mode switch can be actuated to operate the apparatus either in a printed web mode or in a plain web mode).

Infeed conveyor 9 is shown to comprise an endless conveyor 95 having a plurality of flight bars 97 spaced along the conveyor and movable with the conveyor for engagement with a unit U to be packaged. Conveyor 95 has a front drive roll 99 driven by a chain and sprocket arrangement 101 via a variable speed transmission 103, the latter being driven by motor M via a chain 105. Transmission 103 has a dual sprocket output shaft 107 around which chain 101 is trained and a selectively actuable electric clutch 109. With clutch 109 deenergized, conveyor 95 is driven at low speed (i.e., at a speed somewhat slower than the speed of web W moving along its path P), and with the clutch energized, the conveyor is driven at a speed faster than the speed of the web. For placement of units on web W, conveyor 95 is partially driven at low speed and partially driven at high speed during the placement of each unit. By varying the time the conveyor is driven at high and low speeds, the position on the web where the unit is deposited relative to preprinted registration marks R on the web may be controlled. Thus, clutch 109 and associated electrical circuitry, as will be hereinafter described, constitutes means for placement of units U on the web relative to respective registration marks R when apparatus 1 is running in its printed web mode.

In accordance with this invention, encoder or pulse counting means as generally indicated at 111, is provided for generating a signal in response to movement of wheel 15 through a predetermined distance (i.e., rotation of the wheel through a predetermined arc). When apparatus 1 is in its printed film mode, this signal generated by means 111 is used to control infeed conveyor 95 and to thus control placement of the units on the web relative to respective registration marks R preprinted thereon. When apparatus 1 is in its plain film mode, the signal generated by means 111 energizes solenoid valve SV and releases a sealing unit 19 in the event photoelectric control system 87 fails to sense the presence of a unit U in tube T within a certain specified travel of the tube since the release of the last sealing unit. This insures that sealing units are released at approximately the proper time, regardless of whether units U are in the tube or not, and thus maintains a sufficient number of sealing units in clamping engagement with the tube to pull web W along path P and to prevent an excessive number of sealing units from stacking up at hold position H.

Generally, means 111 may be described as a pulse counter or encoder which generates a certain number of pulses in response to wheel 15 moving through a certain unit distance. For example, one pulse may be generated for each 0.1 inch (2.5 mm.) movement of web W with the wheel. Means 111 also includes a counter C (FIG. 10) for counting the pulses generated, this counter being remotely adjustable to count any desired number of pulses. Upon counting this desired number of pulses, a signal is generated (for purposes as will appear) and the counter is again reset to begin counting a new series of pulses. Means 111 will be described in greater detail hereinafter.

In FIG. 8, photoelectric control system 81 for releasing sealing units 19 in timed relation to passage of registration marks R therepast is shown schematically. Power is supplied to the system through an on-off switch S1 in line L1, to a photoelectric control unit PC1, such as that commercially available from the Tri-Tronic Company, Inc. under their trade designation "Model P-89", and to a switch S2 which supplies power to a circuit which selectively energizes clutch 109 in the drive of infeed conveyor 9 so as to initiate high speed operation of the conveyor at a time so selected as to deposit a unit U on web W in proper relation to registration marks R on the web. Lamp 83 and photocell 85, as heretofore described, are supplied power from pin P7 of the photoelectric control unit PC1 via a line L3, and photocell 85 provides an output to pin P8 of the photoelectric control unit. Upon registration marks R on the web interrupting the light beam from lamp 83 to photocell 85, the output of the photocell changes and thus causes photoelectric control unit PC1 to provide an output voltage to solenoid valve SV and to the relay coil of a relay switch C1 via a line L4 from pin P3. Actuation of solenoid valve SV pressurizes air cylinder 27 to effect the release of a sealing unit 19 at hold position H and to couple it to sealing wheel 15 in timed relation to movement of web W. A holding circuit (as will be hereinafter explained) for relay C1 holds solenoid SV open and a limit switch LS1 actuable by movement of the just-released sealing unit 19 breaks the holding circuit of relay C1 and thus deenergizes solenoid valve SV.

Figure 9:
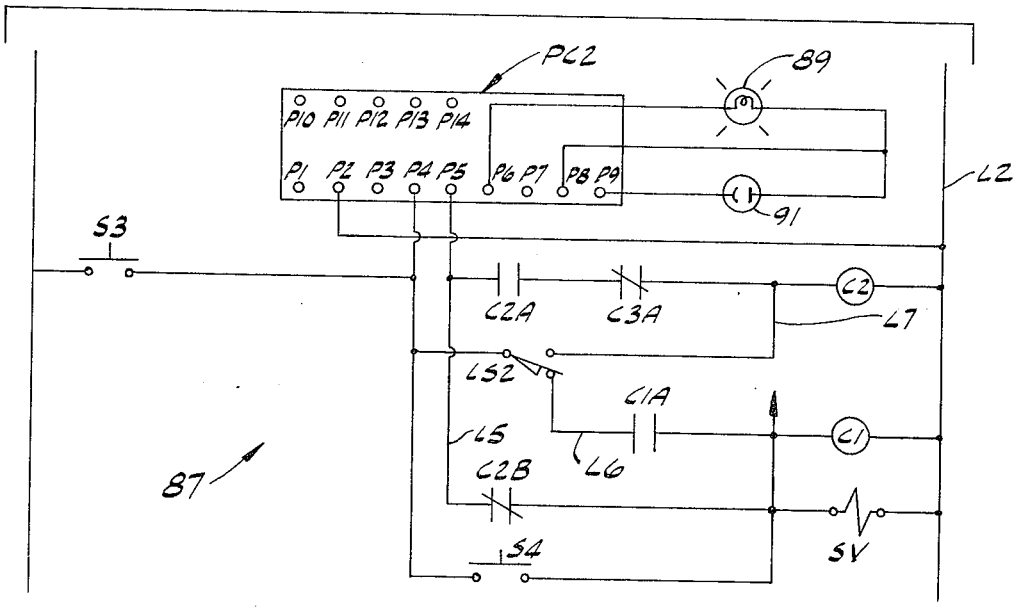
FIG. 9 is an electrical schematic of a photoelectric control system for the apparatus when packaging units in plain or unprinted web.

Referring now to FIG. 9, photoelectric control unit system 87 is schematically shown in which power is supplied by a manual on-off switch S3 to a photoelectric control unit PC2, generally similar to unit PC1 heretofore described, to a limit switch LS2, and to a manual momentary pushbutton switch S4. Lamp 89 and photocell 91 are incorporated in photoelectric control unit PC2 and are energized thereby with the output of the photocell supplied to terminal P9 of the control unit. Upon a unit U interrupting the light beam between lamp 89 and photocell 91, the output of the photocell changes and it causes control unit PC2 to supply an output voltage to solenoid valve SV and to the relay coil of relay C1 via pin p5 and a line L5. With relay C1 actuated, its normally open contact C1A is closed thus initiating the above referred to holding circuit for relay C1 to supply power to the relay coil of relay C1 and to solenoid valve SV. Thus, limit switch LS2 supplies power to solenid valve SV via a line L6 until the sealing unit 19 just released travels with wheel 15 from hold position H and trips limit switch LS2 thereby opening line L6, deenergizing the solenoid valve, and resetting relay C1. Actuation of limit switch LS2 energizes the coil of a relay C2 in a line L7 and thus closes the normally open contacts C2A of relay C2 in line L7 and opens its normally closed contacts C2B in line L5 which insures that power is removed from solenoid valve SV. Also, power is supplied to the coil of relay C2 from photoelectric control unit PC2 via line L7 to hold relay C2 on. As long as light from lamp 89 strikes photocell 91, photoelectric control unit PC2 provides power to its pin P8 and line L5. Upon a unit U in tube T interrupting the light beam between lamp 89 and photocell 91, power is removed from line L5 thus resetting relay C2 and returning its contacts C2A and C2B to their normally open and normally closed positions, respectively, and deenergizing solenoid valve SV. C1 is reset when LS2 picks up relay C2 prior to the reset of relay C2.

Figure 7:
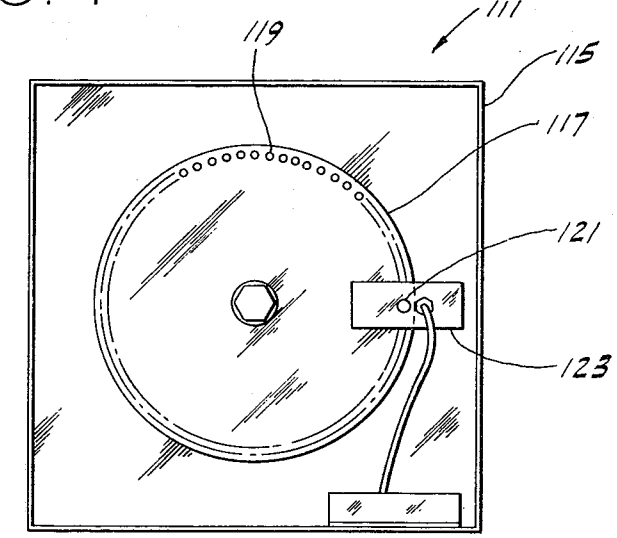
FIG. 7 is an enlarged view of an encoder driven at a speed proportional to the speed of the wheel.
Figure 10:
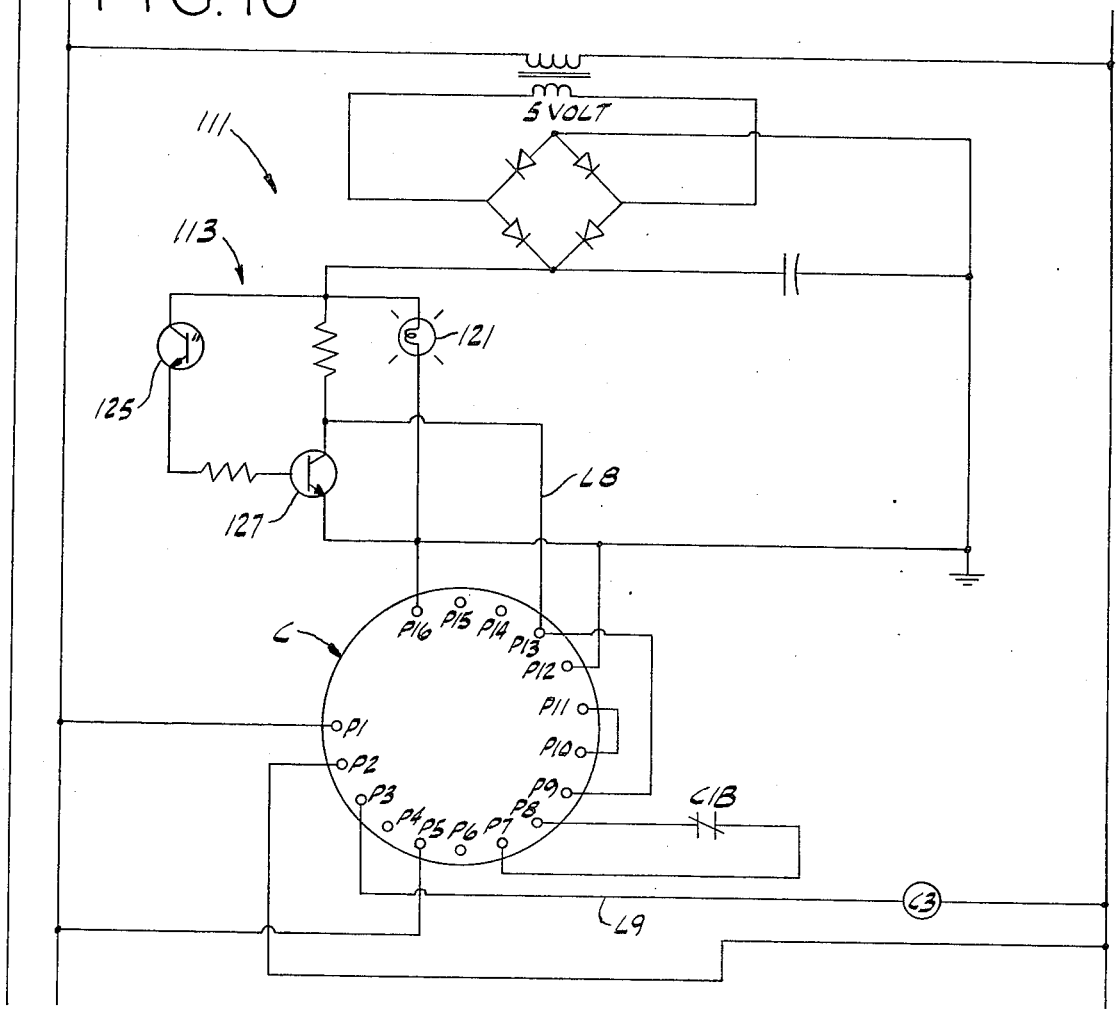
FIG. 10 is an electrical schematic of the encoder shown in FIG. 7 with interconnections to electronic counting means and to a power supply.

Referring now to FIG. 10, means 111 is shown schematically. As heretofore stated, encoder or pulse counting means 111 is used both in the printed web mode in which it generates a signal to energize clutch 109 so as to place units U on web W in proper relation to registration marks R and in the plain film mode in which it serves as a backup to photoelectric control system 87 to release sealing units 19 in the event photoelectric control unit PC2 does not sense the passage of units U thereby. Means 111 is an encoder unit enclosed in a box 115 (see FIGS. 1, 7 and 10) mounted on frame 3. An encoding wheel or disk 117 is journalled in the box and has a series of equally spaced apertures 119 around its periphery. For example, there may be ninety such apertures therein. Disk 117 is rotary driven by motor M at a speed proportional to the speed of wheel 15, preferably at a speed faster than the speed of the wheel (4:1), by a chain and sprocket drive 120. A lamp 121 is mounted on one side of disk 117 by a fixture 123 supported by the box and a photosensitive transistor 125 (or other light detector) is mounted on the opposite side of the disk (not shown in FIG. 7) by the fixture so that a light beam from the lamp is directed toward the light-sensitive transistor. Upon operation of apparatus 1, disk 117 is rotated by chain and sprocket drive 120 at a speed proportional to the speed of rotation of wheel 15, and thus holes 119 in the disk intermittently permit the transmission of light to light-sensitive transistor 125 thus causing its output to vary. Photosensitive transistor 125 is connected to the base of transistor 127 thus applying a base bias voltage to transistor 127 and constituting a logic circuit. This in turn causes transistor 127 to saturate and to change its operating state from off to on. When transistor 127 turns on, its collector voltage goes from 5 volts to its saturation voltage (about 0.6 volt) or logic zero and induces a negative pulse on line L8 to pin P13 of counter C. Preferably, counter C is a commercially available counter, such as that available from Automatic Timing and Controls, Inc., King of Prussia, Pennsylvania, under their trade designation "Shawnee Series 334". Counter C is an adjustably settable counter which, upon counting a preset number of pulses from transistor 127, supplies an output voltage to its output terminal P3 and to a line L9. The counter is remotely preset by means of a digital setting switch 129 on control panel 93. As heretofore mentioned, a certain number of pulses are generated by encoder 111 upon wheel 15 moving through a specified unit distance (e.g., one pulse for each 1/10 inch movement of the wheel). Thus, an operator by adjustably setting switch 129 may preset the counter to generate its output voltage after wheel 15 has rotated a desired distance corresponding generally to a package length for the packages or units being packaged. Counter C has an internal solid-state comparator so that when the number of pulses counted is equal to the number of pulses specified by the setting of switch 129, the counter generates an output voltage. When operating in the printed web mode, this signal is used to energize clutch 109, and when operated in the plain web mode, this signal effects the release of a sealing unit 19. As shown in FIG. 10, a normally closed contact C1B of relay C1 is provided between pins P7 and P8 of counter C to reset the counter to zero. Upon the counter counting out, it operates a signal from the pin P3 to latch a momentary relay switch C3.

It will be understood that switches S1, S2 and S3 may be incorporated in a single 3-position switch (i.e., printed web mode, off, and plain web mode) on control panel 93 and thus constitute mode switch M3 heretofore described.

Operation of means 111 is as follows: With mode switch MS in the printed web mode position and with infeed conveyor 9 operating at low speed, counter C is preset to generate a signal prior to photocell control unit PC1 sensing a registration mark R on web W. Upon the counter counting out, it supplies voltage to the relay coil of momentary relay C3 via line L9 which causes the normally open contacts C3B in line L10 (see FIG. 8) to close. This in turn energizes the relay coil of a relay C4 which closes its normally open contacts C4A in a line L11 and C4B in a line L12 and energizes the coil of clutch 109 with d.c. current from a bridge rectifier 131 thus causing the infeed conveyor to travel at high speed. Clutch 109 remains energized by a holding circuit for relay C4. A limit switch LS3 in line L11 is tripped by movement of the infeed conveyor past the point where a unit U on the conveyor is to be placed on web W thus opening line L11 and resetting relay C4. This deenergizes clutch 109 and causes conveyor 95 to again travel at low speed. By adjusting setting switch 129 on control panel 93, an operator may readily adjust the point at which clutch 109 is energized during the placement of each unit U on web W and thus may accurately position units U on the web relative to their registration marks R.

With mode selector switch M3 in the plain web mode, photoelectric control unit PC2 senses the passage of units U thereby and releases sealing units 19 in timed relation to passage of units U. As previously mentioned, after passage of a unit U past photocell 91 and after the release of a sealing unit 19 with consequent opening of limit switch LS2, relay C2 is maintained in its latched position. Normally, the next successive unit U on web W would momentarily block photocell 91 and remove voltage from line L5 which would reset relay C2. However, if the next unit U is not sensed, relay C2 will hold, no sealing unit 19 will be released, and relay switch C1 will not be energized to reset counter C. Thus, after wheel 15 has travelled a distance greater than the desired spacing of sealing units 19 on the wheel to form seals between successive units U to be packaged, counter C will count out and will energize momentary relay C3 which causes its contact C3A (see FIG. 9) to open and thus to reset relay switch C2. This causes the normally closed contact C2B in line L5 to close and to shift the output voltage of photoelectric unit PC2 to solenoid valve SV and to the relay coil of relay C1. This in turn releases a sealing unit 19 and resets counter C. As an example of how systems 87 and 111 operate, in the plain web mode with units U having a package length of 7.5 inches (190 mm.), switch 129 is set so that counter C counts out after wheel 15 has travelled a distance somewhat greater than the desired package length (e.g., 7.6 inches or 193 mm.). Normally, photoelectric control system 87 senses the passage of a unit U and releases a sealing unit 19 and resets Counter C. In the event photoelectric control system 87 does not sense the passage of a unit U, the counter counts out and releases a sealing unit after it counts the preset number of pulses corresponding to a movement of web W with wheel 15 greater than 7.6 inches (193 mm.). Thus sealing units 19 will be released regardless of whether units U are present on web W or not.

In view of the above, it will bs seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for packaging units in flexible sheet material wherein the units are spaced longitudinally in a tube of said material and the apparatus has means for sealing the tube between the units, said sealing means comprising:

a wheel rotatable or an axis;

a series of sealing units carried by the wheel;

each sealing unit having means for coupling it to the wheel for travel therewith and adapted for uncoupling of the sealing unit from the wheel to allow the wheel to rotate while the sealing unit remains stationary;

means for arresting a first sealing unit at a hold position and for actuating its coupling means to uncouple said sealing unit from the wheel, said arresting means being movable between an operative position in which it is engageable by said coupling means of said first sealing unit to arrest said first sealing unit and to uncouple it from the wheel and a retracted position for release of the sealing unit to travel with the wheel, said arresting means being movable from its operative to its retracted position in response to a signal;

means for generating said signal in response to passage of a unit by a reference point so as to couple the first sealing unit to the wheel in timed relation to movement of the units with the tube for sealing the latter between successive units; and backup means for generating said signal in response to movement of said wheel through a distance greater than a predetermined distance for the units being packaged in the event said generating means fails to sense the passage of a unit by said reference point, said backup means being reset prior to generating said signal by the release of a sealing unit in response to generation of said signal by said generating means, said backup means comprising means for generating a number of pulses corresponding to the wheel moving through a unit length, and means for counting said pulses and for generating said signal upon counting a specified number of pulses corresponding to said distance greater than said predetermined distance for the units.

2. Apparatus as set forth in claim 1 wherein said pulse generator means comprises a light source, a detector responsive to changes in the light from said source, means driven by said wheel for alternately blocking said light from said source to said detector, and logic means connected to said detector for generating a pulse each time said detector responds to a change in light from said source.

3. Apparatus as set forth in claim 2 wherein said logic means is connected to said counter for supplying pulses thereto, said counter having means for comparing the number of pulses received from said logic means with said specified number of pulses and for generating said signal when the number of pulses received equal said specified number.

4. Apparatus as set forth in claim 3 wherein said counter includes means for selectively adjusting said specified number of pulses thereby to accommodate units of different lengths.

5. Apparatus as set forth in claim 2 wherein said means driven by said wheel comprises a disk rotatable about an axis and having a plurality of equally spaced apertures around said axis, said source being located on one side of said disk and said detector being located on the other side of said disk, said disk being rotatably driven at a speed proportional to the speed of said wheel and said apertures in said disk intermittently permitting light to pass through said disk to said detector.

6. Apparatus as set forth in claim 5 wherein said disk is driven at a speed substantially faster than said wheel.

7. Apparatus for packaging units either in flexible sheet material having registration marks constituting reference points preprinted at intervals on the web for positioning said units to be packaged, or in plain flexible sheet material free of said registration marks, said apparatus comprising means for conveying a web of said material along a path through said apparatus, means for placing said units to be packaged on said web in spaced longitudinal relation to one another, means for forming said web into a tube around the units to be packaged with the units spaced longitudinally in the tube, means for sealing the tube between said units, and mode selection means selectively actuable between a printed web mode for controlling operation of said apparatus for packaging said units in said preprinted web and a plain mode for controlling operation of said apparatus for packaging said units in said plain web, said sealing means comprising:

a wheel rotatable on an axis;

a series of sealing units carried by the wheel;

each sealing unit having means for coupling it to the wheel for travel therewith and adapted for uncoupling the sealing unit from the wheel to allow the wheel to rotate while the sealing unit remains stationary;

means for arresting the first sealing unit at a hold position and for actuating its coupling means to uncouple said sealing unit from the wheel, said arresting means being movable between an operative position in which it is engageable by said coupling means of said first sealing unit to arrest said first sealing unit and to uncouple it from the wheel, and a retracted position for release of the sealing unit to travel with the wheel, said arresting means being movable from its operative to its retracted position in response to movement of the units with the tube for sealing the latter between successive units;

said apparatus further comprising means for generating a signal for actuating said arresting means so as to effect coupling of said first sealing unit at said hold position to said wheel in timed relation to movement of said registration marks past a reference point when said mode selection means is in its printed web mode or in timed relation to passage of a unit to be packaged past another reference point when said mode selection means is in its plain film mode; and other means for generating another signal in response to movement of said wheel a predetermined distance, this last said signal controlling operation of said unit placement means when said mode selection means is in said printed film mode to place each of said units to be packaged at a desired location on the web relative to respective registration marks or for effecting the release of the first sealing unit at said hold position when said mode selector means is in said plain film mode in the event said signal generating means fails to detect the passage of a unit past said reference point, said other means comprising means for generating a number of pulses corresponding to the wheel moving through a unit length, and means for counting said pulses and for generating said other signal upon counting a specified number of pulses corresponding to a desired movement of said wheel.

* * * * *